United States Patent [19]

Koeneman et al.

[11] Patent Number: 4,513,892

[45] Date of Patent: Apr. 30, 1985

[54] FLAKED ICE DISPENSER

[75] Inventors: Robert M. Koeneman; Benjamin D. Miller, both of Elmwood Park; Thaddeus M. Jablonski, Palatine; Albert L. Schafer, Chicago, all of Ill.

[73] Assignee: Remcor Products Company, Franklin Park, Ill.

[21] Appl. No.: 485,394

[22] Filed: Apr. 15, 1983

[51] Int. Cl.[3] ..... B65D 23/00

[52] U.S. Cl. ..... 222/235; 222/408; 222/410; 366/196

[58] Field of Search ..... 222/235, 240, 290, 408, 222/410; 366/195, 196, 205, 314

[56] References Cited

U.S. PATENT DOCUMENTS

| | | | |
|---|---|---|---|
| 2,280,166 | 4/1942 | Sinden | 222/240 X |
| 3,268,118 | 8/1966 | Hoenisch | 222/240 X |
| 3,517,860 | 6/1970 | Whalen | 222/554 X |

*Primary Examiner*—Joseph J. Rolla
*Assistant Examiner*—Frederick R. Handren
*Attorney, Agent, or Firm*—Gary, Juettner & Pyle

[57] ABSTRACT

A flaked ice dispenser comprises a hopper for reception of a mass of small particles of ice, the hopper having a circular upper portion and a polygonal shaped lower portion the corners of which extend outwardly of the upper portion, an impeller which is rotatable in the hopper and has a conical body and equally spaced arms extending radially therefrom, and an ice diverting assembly at an outlet from the hopper. The round upper hopper portion allows ice in that portion to rotate without substantial resistance, the corners of the lower portion allow for displacement of ice therein from the main mass thereof, and the diverting assembly facilitates movement of ice through the outlet. The dispenser enables flaked ice to remain in free flowing form without agglomeration and to be readily dispensed.

17 Claims, 4 Drawing Figures

FLAKED ICE DISPENSER

BACKGROUND OF THE INVENTION

The present invention relates to ice dispensers, and in particular to an improved dispenser for flaked ice.

In the food and beverage service industries it is desirable to provide means for expeditiously dispensing of quantity of ice, for example into a glass, to facilitate service of ice water and cold beverages to customers, or for use on a buffet table to cool prepared foods. Conventionally, the means comprises an ice dispenser, which for commercial applications usually includes a hopper for storing a quantity of crushed, cracked, flaked or cubed ice, an icemaker for manufacturing ice for the hopper, and an agitator for the mass of ice to prevent congealing or agglomeration thereof in order to maintain the ice particles in discrete free flowing form and to facilitate dispensing ice. An opening at the bottom of the hopper enables ice to be removed from the hopper, for example by a dispensing unit which automatically provides a measured quantity of ice or which continuously provides ice for as long as it is actuated.

Heretofore, much effort has been expended to provide various kinds of knives and blades in a hopper for particulate ice to prevent the ice from congealing or agglomerating, to maintain the ice particles in discrete free flowing form, and to facilitate dispensing of ice. In one type of dispenser, a rotating cutter equipped with knives or blades is supposed to slash its way through a stationary mass of small particles of ice to maintain them in discrete form. In another, the ice is rotated as a mass in a circular hopper and the hopper is equipped with vertical and radial knives or blades to slash through the rotating mass. In U.S. Pat. No. 3,393,839, the latter type of device has been equipped with stationary blades of such character as to impart undulating or tremor-like movements to the ice both vertically and radially to maintain the ice as individual free flowing particles. In addition, hoppers of noncircular designs have been used with such knives and blades to enhance the undulating movement imparted to the ice particles.

Although prior dispensers are well suited for dispensing relatively large particles of ice, such as cubed ice, they are ill equipped to dispense flaked ice. The difficulty resides in the fact that flaked ice is comprised of relatively small ice particles, such that conventional agitators, comprising knives and blades, tend to slice through the mass of ice rather than rotate or move it. Therefore, the agitators do not impart movement to the mass of flaked ice in a manner to maintain the ice as individual free flowing particles, and the situation is made worse when hoppers of noncircular cross section are used, since such hoppers, although enhancing undulation of large particles of ice, impede rotation of flaked ice and enable the agitator to even more easily cut through the ice without moving it.

OBJECT OF THE INVENTION

The primary object of the present invention is to provide an improved dispenser for flaked ice, which is able to store a relatively large mass of flaked ice, maintain the ice in free flowing form and reliably dispense the same.

SUMMARY OF THE INVENTION

In accordance with the present invention, an ice dispenser for small particles of ice, such as flaked ice, comprises a hopper for storage of a mass of small particles of ice, an impeller rotatable in the hopper for rotating and agitating the ice therein and for moving the ice to and through a discharge opening in the hopper, and an ice diverting assembly at the hopper opening for facilitating movement of ice through the opening.

In accordance with a preferred embodiment, the hopper has a central bottom wall, a trough around the outer periphery of the bottom wall and a discharge opening therethrough in communication with the trough. The impeller includes a cone shaped body portion mounted for rotation in the hopper with its vertex above the hopper bottom wall and its outer surface extending outwardly and downwardly from the vertex, and a plurality of arms mounted in spaced angular relationship on the outer surface. The arms extend outwardly of the body outer surface and along paths extending between the vertex and the base of the body, and means are provided for rotating the impeller in the hopper to rotate and agitate ice therein to prevent the small particles of ice from agglomerating and congealing, to move ice in the trough to and through the hopper discharge opening, and to cause ice in the hopper overlying the trough to enter the trough as ice is discharged through the opening.

The hopper is specially configured to facilitate dispensing of flaked ice. To that end, the impeller has an axis of rotation about the altitude of the cone shaped body and the hopper, in cross section perpendicular to the axis of rotation of the impeller and between an upper end thereof and the central bottom wall, has a substantially circular upper portion and a substantially polygonal lower portion. The lower portion has corners which extend outwardly of the circumference of the upper portion, whereby as ice is discharged from the hopper, ice in the upper hopper portion falls into the corners of the lower portion and then into the trough.

To further facilitate dispensing of flaked ice, the hopper trough is annular and has an inner surface which extends from the bottom of the trough to the periphery of the hopper bottom wall, and the impeller arms extend toward the bottom of the trough in closely spaced relationship to the trough inner surface. In addition, the ice diverting assembly at the hopper discharge opening includes a plate extending from a downstream side of the opening, in the direction of impeller rotation, into the trough for engaging ice moved therethrough by the impeller and directing the ice through the opening. The ice diverting assembly also has a rod extending from the downstream side of the hopper opening into the trough and toward the bottom thereof for engaging ice moved along the bottom and causing it to form a ramp for movement of ice therealong from the trough bottom to and through the opening.

In consequence of the particular structure of the hopper, agitator and ice diverting assembly, flaked ice may readily be stored and dispensed without congealing or agglomerating, while at the same time the hopper may be filled with a quantity of flaked ice far in excess of that heretofore possible.

The foregoing and other objects, advantages and features of the invention will become apparent upon a consideration of the following detailed description, when taken in conjunction with the accompanying drawings.

DETAILED DESCRIPTION

Figure 1:
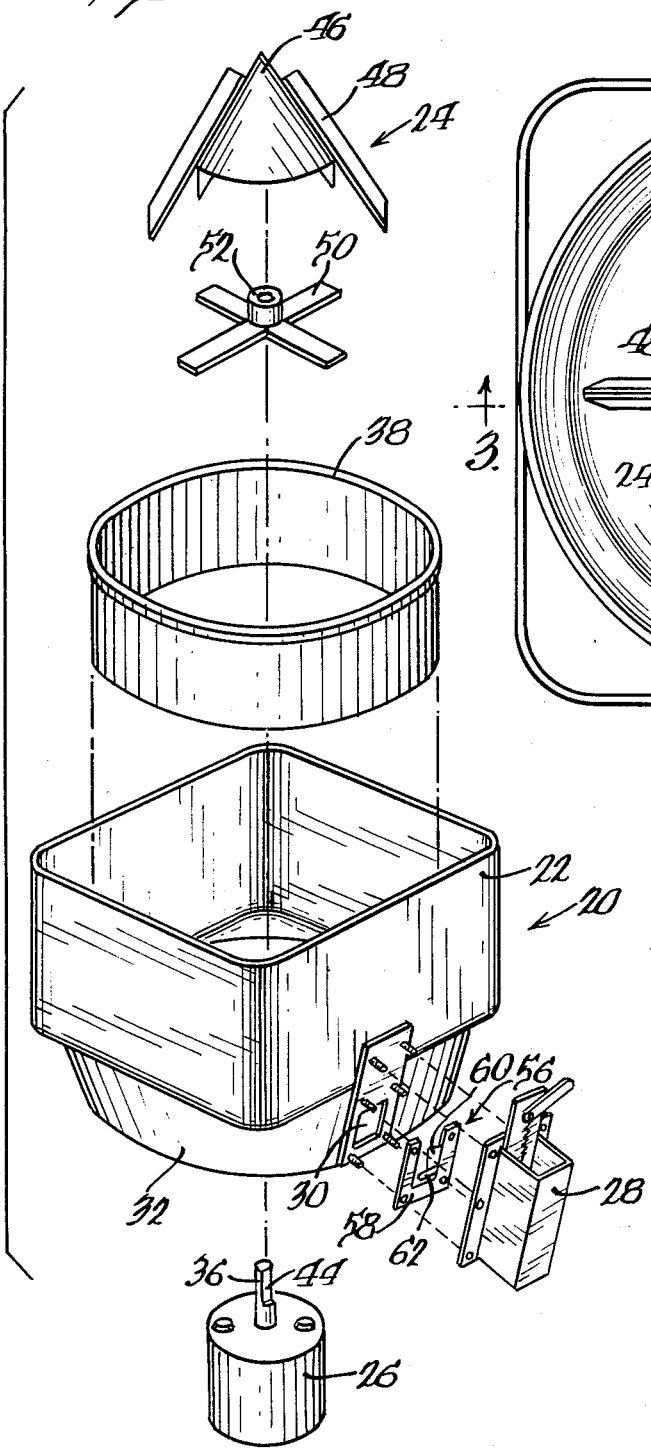
FIG. 1 is an assembly view of a flaked ice dispenser configured in accordance with the teachings of the present invention.
Figure 2:
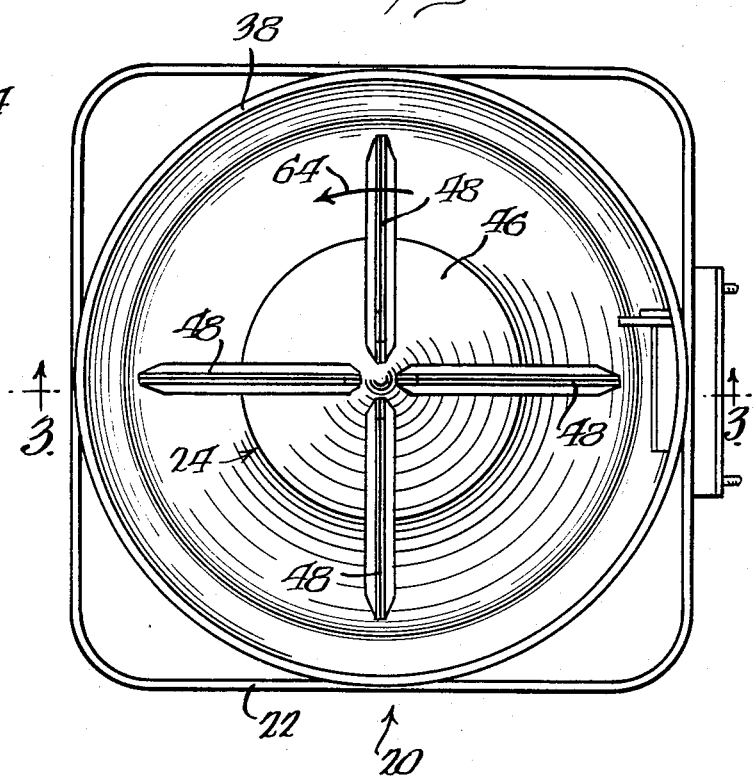
FIG. 2 is a top plan view of the dispenser, showing the configuration of the hopper, a circular insert in the hopper which gives the hopper a circular upper end and an agitator in the hopper for rotating a mass of flaked ice.
Figure 3:
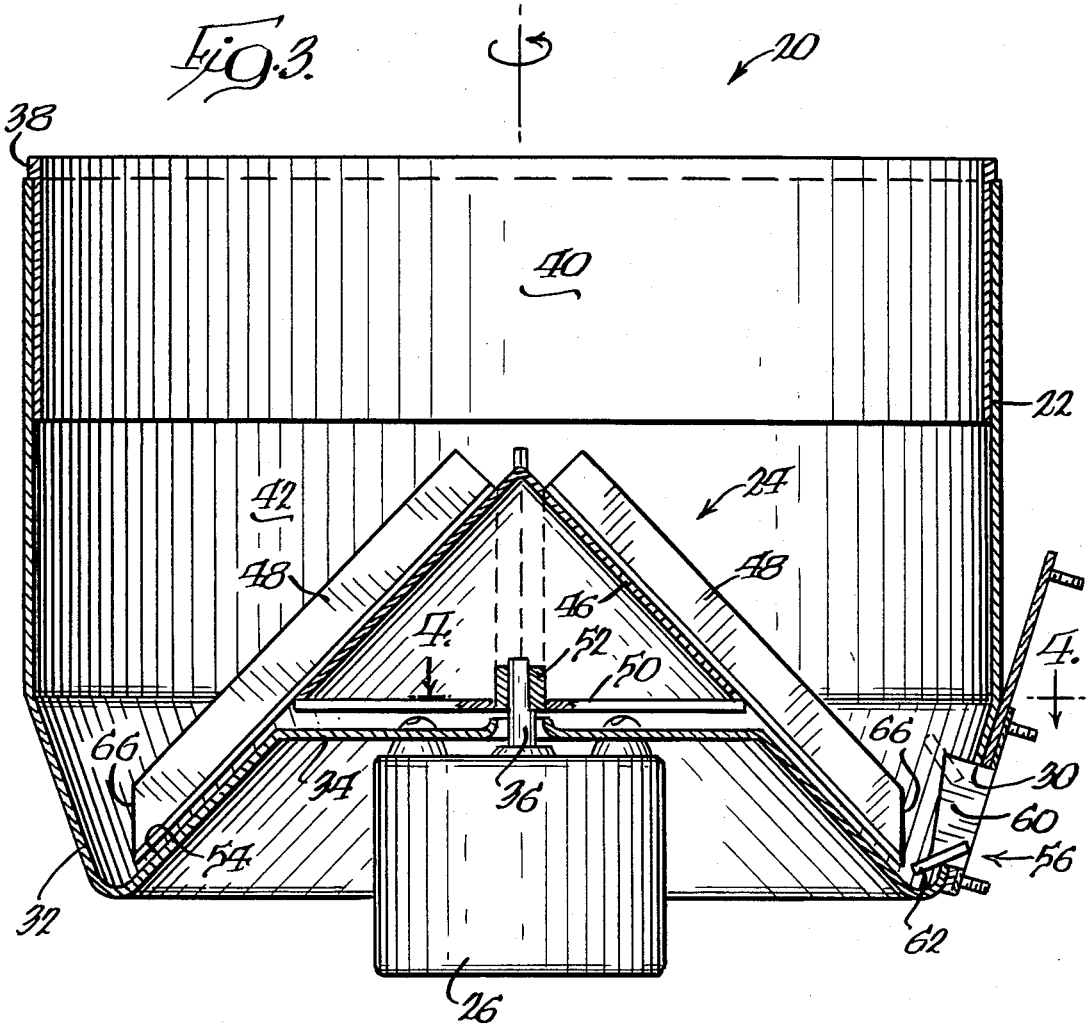
FIG. 3 is a cross sectional side elevation view taken substantially along the lines 3—3 of FIG. 2, illustrating the agitator and an ice diverting assembly for promoting a flow of ice from the hopper through a dispensing opening.
Figure 4:
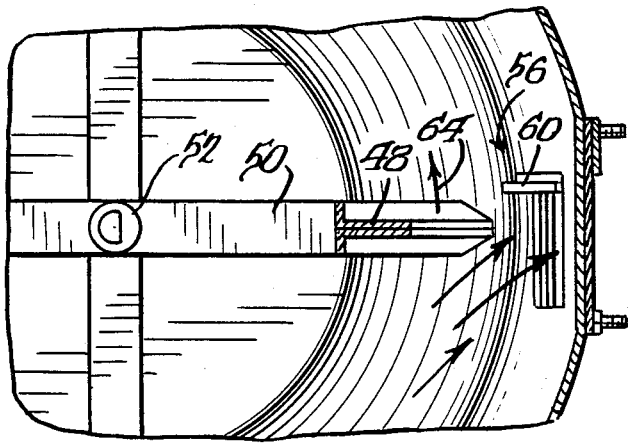
FIG. 4 is a fragmentary cross sectional view taken substantially along the lines 4—4 of FIG. 3, and shows the positioning of the ice diverting assembly at the dispensing opening.

There is shown in the drawings an embodiment of flaked ice dispenser presently contemplated as the best mode for carrying out the invention. To the extent conventional the ice dispenser, indicated generally at 20, is comprised of a hopper, bin or tank 22 for storing a large quantity of flaked ice, a rotary impeller or agitator, indicated generally at 24, driven by an electric motor 26, and dispensing means 28 for accommodating controlled discharge of ice from the lower end of the hopper through a discharge opening 30.

The dispensing means 28, although not forming part of the present invention, is highly desirable to enable convenient dispensing of ice in the hopper, and may take the form of any of the dispensing means disclosed in U.S. Pat. Nos. 3,165,901, 3,211,338 and 3,211,509, and particularly the form disclosed in U.S. Pat. No. 4,346,824, to which reference is made for a more detailed description. As is known and understood, the dispensing means is advantageously electrically coupled with the motor 26, whereby upon the dispensing means being actuated to discharge ice from the hopper, the motor 26 to rotates the impeller 24 to facilitate movement of ice through the opening 30.

Although, as will become apparent, a hopper 22 could be specially configured in accordance with the teachings of the invention, the invention economically contemplates retrofitting the hoppers of some existing dispensers for use with flaked ice, such that the same may, if desired, later be conveniently reconverted for dispensing cubed ice. To that end, the hopper 22 is of known design and essentially an open top tub, the major part of which comprises a main housing portion of polygonal cross section as disclosed in U.S. Pat. No. 3,517,860, the teachings of which are specifically incorporated herein by reference. As taught in that patent, the polygonal cross section of the hopper facilitates maintaining relatively large particles of ice in discrete, free flowing form, and the bottom of the hopper is provided with a circular depression comprising an annular trough 32 in which the discharge opening 30 is formed. The opening is spaced a short distance above the bottom of the trough, and the trough is appropriately provided at its bottom with melt water drain holes (not shown), so that only discrete particles of relatively dry ice will be discharged through the opening. The bottom of the hopper is closed by an end wall 34, so that ice to be discharged gravitates into and is confined within the trough.

The hopper may be made in any conventional manner, such as by deep drawing of sheet metal or the molding of plastics, and when completed is sheathed in insulation and provide with a removable insulated cover, all as is well known in the art.

The bottom wall 34 of the hopper 22 is centrally apertured for upward, liquid sealed passage therethrough of a shaft 36 of the drive motor 26, the motor being suitably mounted on the wall exteriorly of the hopper. Mounted on the motor shaft within the interior of the hopper is the impeller or agitator 24, which is rotated by the motor to rotate and agitate ice in the hopper. The motor may comprise an electric gear motor coupled with the discharge means 28, such that the motor is operated during operation of the discharge means to facilitate a free flow of discrete flaked ice particles therethrough. To maintain a supply of ice in the hopper and to replenish ice discharged through the dispensing means, an icemaker (not shown) may be provided for introducing flaked ice into the hopper. In the alternative, the hopper may be manually filled with a supply of flaked ice.

To the extent described the ice dispenser is conventional and, if equipped with an agitator of the type disclosed in said U.S. Pat. No. 3,517,860, would be well adapted for receiving and dispensing ice of relatively large particle size, for example cubed ice. However, it would not satisfactorily be able to maintain flaked ice in free flowing form and to dispense such ice, since the relatively thin blades of the agitator would simply slice through the ice without imparting rotation to the mass of ice, which problem would be aggravated by the resistance to rotation imparted to the mass of ice by the polygonal shape of the hopper. The invention therefore contemplates that a conventionally designed ice dispenser be modified to accommodate dispensing of flaked ice, or that a flaked ice dispenser, configured according to the teachings of the invention, be specially fabricated.

Accordingly, to convert a conventionally designed ice dispenser of the type described to one for dispensing flaked ice there is provided, first, an annular or cylindrical sleeve 38 within the upper end of the hopper 22. The sleeve is of a diameter to generally contact each of the four hopper walls, and is secured in position to the walls by any suitable means, for example by removable fasteners (not shown) which attach the sleeve to the hopper at each side wall. The sleeve, which extends from the top of the hopper only a portion of the way downwardly into the hopper, converts the upper end of the hopper from polygonal to circular cross section, thereby providing within the hopper and above the bottom wall 34 an upper circular hopper portion 40 and a lower polygonal portion 42.

Secondly, in addition to providing the sleeve 38 within the hopper 22, the conventional agitator is removed from within the hopper and replaced with one specially configured for the purpose of dispensing flaked ice. Replacement is readily accomplished since an agitator for an ice dispenser is not fixedly secured to the agitator motor output shaft, but instead is simply slipped over the shaft and constrained for rotation therewith by means of a flat on the shaft, for example the flat 44 on the motor shaft 36. Thus, the conventional agitator may simply be lifted out of the hopper and replaced by one configured as is the agitator 24.

More particularly, the impeller 24 includes a central and hollow cone shaped body 46 on the surface of which is carried a plurality of equally spaced arms 48, for example four arms as shown. Each arm extends generally perpendicularly outwardly from the surface of the cone shaped body, or radially outwardly of the axis of rotation or altitude of the cone, and has a relatively large area vertical face on at least the side thereof facing the direction of rotation of the impeller. To mount the cone shaped body and arms on the motor output shaft 36, with the vertex of the body above the hopper bottiom wall 34 and the surface of the body extending outwardly and downwardly from the vertex, a cruciform shaped impeller mounting member 50 is connected with the base of the body. The mounting member carries a sleeve 52 having a passage therethrough with a flat therein, whereby the impeller may be mounted for rotation within the hopper by extending the motor shaft through the sleeve passage, with the flats on the shaft and in the passage in alignment. The arms 48 extend beyond the base of the body, such that with the impeller mounted on the motor shaft the base of the biody extends across and generally covers the upper surface of the hopper end wall 34, and the arms extend beyond the end wall and body base toward the bottom surface of the annular trough 32 in close proximity with an inner wall 54 of the trough. It is to be appreciated, however, that the cone shaped body could just as readily have an altitude sufficient to extend along the entire length of the arms 48, in which case it would extend into and toward the bottom of the trough in close proximity with the trough inner wall 54.

The final and third modification of the conventional ice dispenser to convert the same to use with flaked ice comprises the provision of an ice diverting assembly, indicated generally at 56, within the hopper at the opening 30. To facilitate mounting of the assembly, the same includes a U-shaped bracket 58 which is appropriately apertured to receive dispensing means mounting studs on the hopper about the opening. Thus, the dispensing means 28 may simply be removed from the mounting studs, the ice diverting assembly placed on the studs about the hopper opening and the dispensing means then remounted on the hopper, thereby to mount the ice diverting assembly on the hopper between the hopper and the dispensing means.

A plate 60 is secured to one side of the U-shaped bracket 58, such that when the ice diverting assembly is mounted on the hopper the plate extends through the discharge opening 30 and partially into the annular trough 32 along the downstream side of the opening in the direction of rotation of the impeller 24. The plate extends generally along the vertical height of the opening, and carries at its lower end a rod 62 which protrudes into and toward the bottom surface of the trough.

The hopper may be manually or automatically filled with flaked ice through the open upper end thereof, such that ice is introduced through the circular upper portion 40 defined by the sleeve 38. When filled, ice is present in the upper portion of the hopper, within a medial area of the lower polygonal portion 42 and in the trough 32, but it does not completely fill the corners of the lower portion which extend outwardly of the circumference of the upper portion. To dispense ice from the hopper, the dispensing means 28 is actuated to unblock the opening 30 and operate the motor 26, which rotates the impeller to move ice within the trough through the opening.

Considering the advantages afforded in the dispensing of flaked ice, the circular sleeve 38 in the upper end of the hopper 22 eliminates the corners near the top of the hopper and allows the ice thereat to be freely rotated by the impeller 24 without the resistance that would be encountered if the ice were to enter corners of the hopper. This is a particularly desirable feature since it would otherwise be very difficult or impossible to break up or rotate flaked ice in the upper end of the hopper because of the lack of weight on the ice thereat.

The particular configuration of the agitator 24 is also quite important to proper dispensing of flaked ice. To that end, the cone shaped body 46 displaces a portion of the volume of ice that would otherwise be within the hopper, and shrouds the upper surface of the hopper end wall 34 to prevent contact of ice therewith, thereby reducing friction between the mass of ice and the hopper. Reducing friction between the ice and hopper is essential in the case of flaked ice, inasmuch as flaked ice readily yields to an impeller and, if there is significant resistance to movement of the ice, the impeller will simply cut through the ice without substantially moving or agitating the main mass thereof. The cone shaped body also desirably directs ice in the hopper toward and into the annular trough 32 for being dispensed through the opening 30.

The shape of the impeller arms 48 also facilitates agitation and dispensing of flaked ice. Because the arms have a large, radially extending surface area for contacting the ice, they do not burrow or cut through the ice when the impeller is rotated, but instead they exert a low pressure per unit of area on the ice and generally cause the ice and impeller to rotate as one body. Also, the considerable vertical extent of the arms causes ice in the upper circular portion of the hopper not only to rotate but also to fracture, along lines generally above each agitator arm, into smaller masses of ice, which reduces the potential for the ice to bridge and congeal.

Absent the ice diverting assembly 56, upon rotation of the impeller 24 the flaked ice would simply tend to be moved past the hopper discharge opening 30 without a substantial flow of ice through the opening. However, because the plate 60 at the downstream side of the opening extends into the annular, trough 32 and is closely spaced from lower, generally vertical ends of the impeller arms 48, upon rotation of the impeller ice is moved against the plate, which creates a controlled back pressure on the ice and promotes exit of loose ice particles out of the opening. In addition, the plate tends to break down large bulk pieces of ice in the trough into smaller particles, which further contributes to efficient dispensing of ice through the opening.

The rod 62 of the diverter assembly serves the useful function of scavenging slush ice from the trough. Slush ice typically forms in the bottom of the trough 32, and as it is rotated by the impeller it engages the rod, which stops its movement and causes it to build up in front of the rod to create a natural "ramp" of packed ice at the opening 30, up which ramp other ice from the bottom of the trough, including slush ice, rides to and through the opening 30. As earlier noted, the opening 30 is above the bottom of the trough to prevent any melt water in the trough from flowing through the opening, whereby the natural ramp of packed ice aids in dispensing ice from the hopper in the same manner as described in U.S. Pat. No. 4,215,803.

In overall operation, when the hopper 22 is filled with flaked ice the upper circular hopper portion 40 contains a circular mass of ice and the lower polygonal portion 42, except for the upper areas of its corners, is also substantially full of ice. Upon actuation of the dispensing means 28 and rotation of the impeller 24, the impeller arms 48 move ice within the trough 32 to and through the hopper opening 30 while the cone shaped body 46 guides ice along its surface and into the trough. The impeller arms also, because of their large ice contact areas, generally rotate the ice in the hopper as one body, including the ice within the upper portion of the hopper, while at the same time the arms cause the mass of ice in the upper portion to fracture into smaller masses so that it does not congeal or agglomerate. Then, as ice is dispensed and the level of ice falls, ice in the upper hopper portion moves downwardly beyond the lower end of the sleeve 38 and falls into the relatively empty corners of the lower hopper portion for entering the trough and being dispensed. The lower polygonal hopper portion thereof serves the important function, by means of its relatively ice free corners, of allowing for displacement of ice from the main mass thereof, inasmuch as the ice can fall into the corners as it breaks up. The corners thereby provide a necessary free area into which ice may fall for proper dispensing of flaked ice.

The invention therefore provides an improved dispenser for flaked ice. By virtue of the particular configuration of the hopper and impeller, as well as use of the ice diverting assembly, flaked ice may readily be dispensed from the hopper, while at the same time a greater quantity of ice may be stored in the hopper than would otherwise be possible. It is to be understood, of course, that while the configuration of the hopper has been described as modified by the circular sleeve 38, the invention also contemplates that a hopper may be initially fabricated in the modified form.

While one embodiment of the invention has been described in detail, various modifications and other embodiments thereof may be devised by one skilled in the art without departing from the spirit and scope of the invention, as defined in the appended claims.

What is claimed is:

1. An ice dispenser for small particles of ice, such as flaked ice, comprising a hopper for storage of a mass of small particles of ice, said hopper having a bottom wall, a trough around the outer periphery of said bottom wall and an opening therethrough in communication with said trough; an impeller rotatable in said hopper for rotating and agitating ice therein, said impeller including a generally cone shaped body mounted for rotation in said hopper about an axis coextensive with its altitude with its vertex above said bottom wall and its surface extending outwardly and downwrdly from said vertex, and a plurality of arms mounted in angularly spaced relationship on said body surface, said arms extending outwardly of said surface and along paths extending generally between said vertex and the base of said body; and means for rotating said impeller in said hopper to rotate and agitate ice therein to prevent the small particles of ice from agglomerating and congealing, to move ice in said trough to and through said hopper opening for being discharged from said hopper, and to cause ice in said hopper overlying said trough to enter said trough to replace ice discharged through said opening, wherein said hopper, in cross section perpendicular to said axis of rotation of said impeller and between an upper end of said hopper and said bottom wall, has a substantially circular upper portion and a substantially polygonal lower portion, and said lower portion has corners which extend outwardly of the circumference of said upper portion, whereby as ice is discharged from said hopper ice in said upper portion falls into said corners and then into said trough.

2. An ice dispenser as in claim 1, wherein each of said impeller arms has a generally vertical surface of relatively large area on the side thereof facing the direction of rotation of said impeller and extends downwardly past said hopper bottom wall into and toward the bottom of said trough.

3. An ice dispenser as in claim 2, wherein said impeller body substantially covers said hopper bottom wall to minimize contact of ice therewith and said plurality of arms are equally angularly spaced on said body surface and extend along slant height lines of said body.

4. An ice dispenser as in claim 3, wherein said trough is annular and has an inner wall extending from said bottom thereof to the periphery of said hopper bottom wall and said impeller arms extend substantially between said body vertex and a position closely spaced from said bottom of said trough in closely spaced relationship with said trough inner wall.

5. An ice dispenser as in claim 1, including an ice diverting assembly at said hopper opening, said ice diverting assembly including a plate extending from a side of said opening downstream of the direction of impeller rotation and into said trough for engaging ice moved through said trough by said impeller and directing ice through said opening.

6. An ice dispenser as in claim 5, wherein said ice diverting assembly further includes a member extending from said downstream side of said hopper opening into and toward said bottom of said trough for engaging ice moved along said bottom by said impeller and causing the ice to form a ramp for movement of ice therealong from said trough bottom to and through said opening.

7. An ice dispenser for small particles of ice, such as flaked ice, comprising a hopper for storage of a mass of small particles of ice and an impeller rotatable in said hopper for rotating and agitating ice therein, said hopper including a bottom wall, a trough around the outer periphery of said bottom wall and an opening therethrough in communication with said trough, said hopper, in cross section to the axis of rotation of said impeller and between an upper end of said hopper and said bottom wall, having a substantially circular upper portion and a substantially polygonal lower portion, said lower portion having corners which extend outwardly of the circumference of said upper portion, said impeller, upon rotation thereof, moving ice in said hopper trough to and through said opening for discharge from said hopper, whereby as ice is discharged from said hopper ice in said upper portion falls into said corners and then into said trough for discharge from said hopper.

8. An ice dispenser as in claim 7, wherein said hopper bottom wall is substantially circular and said trough is annular.

9. An ice dispenser as in claim 7, wherein said impeller includes a cone shaped body mounted for rotation in said hopper about an axis coextensive with its altitude with its vertex above said bottom wall and its surface extending outwardly and downwardly from said vertex, and a plurality of arms mounted in spaced angular relationshp on said body surface and extending outwardly of said surface and along paths extending between said vertex and the base of said body.

10. An ice dispenser as in claim 9, wherein each of said plurality of impeller arms has a generally vertical surface of relatively large area on the side thereof facing the direction of rotation of said impeller and extends downwardly past said bottom wall into and toward the bottom of said trough.

11. An ice dispenser as in claim 10, wherein said hopper bottom wall is circular, said trough is annular and has an inner wall extending from said bottom thereof to said periphery of said hopper bottom wall, said cone shaped body substantially covers said bottom wall to minimize contact of ice therewith, and said plurality of arms are equally angularly spaced around said body surface and extend along slant height lines of said body.

12. An ice dispenser as in claim 11, wherein said impeller arms extend substantially between said body vertex and a position closely spaced from said trough bottom in closely spaced relationship with said trough inner wall.

13. An ice dispenser as in claim 7, wherein said hopper, in cross section perpendicular to said axis of rotation of said impeller and between an upper end thereof and said bottom wall is substantially polygonal, and including a substantially cylindrical sleeve in the upper portion of said hopper defining said substantially circular upper hopper portion.

14. An ice dispenser as in claim 7, including an ice diverting assembly at said hopper opening, said ice diverting assembly including a plate extending from a side of said opening downstream of the direction of impeller rotation and into said trough for engaging ice moved through said trough by said impeller and directing ice through said opening.

15. An ice dispenser as in claim 14, wherein said ice diverting assembly further includes a member extending from said downstream side of said hopper opening into and toward said bottom of said trough for engaging ice moved along said bottom by said impeller and causing the ice to form a ramp for movement of ice therealong from said trough bottom to and through said opening.

16. An ice dispenser for small particles for ice, such as flaked ice, comprising a hopper for storage of a mass of small particles of ice, said hopper having a bottom wall, a trough around the outer periphery of said bottom wall and an opening therethrough in communication with said trough; an impeller rotatable in said hopper for rotating and agitating ice therein and for moving ice in said trough to and through said opening; and an ice diverting assembly at said hopper opening, said ice diverting assembly including a plate extending from a side of said opening downstream of the direction of impeller rotation and into said trough for engaging ice moved through said trough by said impeller and directing ice through said opening, wherein said ice diverting assembly further includes a rod-like member extending from said downstream side of said hopper opening below said plate and into and toward said bottom of said trough for engaging ice moved along said bottom by said impeller and causing the ice to form a ramp for movement of ice therealong from said trough bottom to and through said opening.

17. An ice dispenser for small particles for ice, such as flaked ice, comprising a hopper for storage of a mass of small particles of ice, said hopper having a bottom wall, a trough around the outer periphery of said bottom wall and an opening therethrough in communication with said trough; an impeller rotatable in said hopper for rotating and agitating ice therein, said impeller including a generally cone shaped body mounted for rotation in said hopper about an axis coextensive with its altitude with its vertex above said bottom wall and its surface extending outwardly and downwardly from said vertex, and a plurality of arms mounted in angularly spaced relationship on said body surface, said arms extending outwardly of said surface and along paths extending generally between said vertex and the base of said body; means for rotating said impeller in said hopper to rotate and agitate ice therein to prevent the small particles of ice from agglomerating and congealing, to move ice in said trough to and through said hopper opening for being discharged from said hopper, and to cause ice in said hopper overlying said trough to enter said trough to replace ice discharged through said opening; and an ice diverting assembly at said hopper opening, said ice diverting assembly including a plate extending from a side of said opening downstream of the direction of impeller rotation and into said trough for engaging ice moved through said trough by said impeller and directing ice through said opening, and a rod-like member extending from said downstream side of said hopper opening below said plate and into and toward said bottom of said trough for engaging ice moved along said bottom by said impeller and causing the ice to form a ramp for movement of ice therealong from said trough bottom to and through said opening.

* * * * *